US008439711B2

(12) United States Patent
Wang et al.

(10) Patent No.: US 8,439,711 B2
(45) Date of Patent: May 14, 2013

(54) MODULAR JACK WITH MAGNETIC MODULE OD REDUCED PROFILE

(75) Inventors: Bing Wang, Kunshan (CN); Yong-Chun Xu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/241,294

(22) Filed: Sep. 23, 2011

(65) Prior Publication Data

US 2012/0171898 A1 Jul. 5, 2012

(51) Int. Cl.
*H01R 24/00* (2006.01)

(52) U.S. Cl.
USPC ..... 439/676

(58) Field of Classification Search ..... 439/676, 439/620.01, 620.06, 620.15, 620.07, 541.5
See application file for complete search history.

(56) References Cited

U.S. PATENT DOCUMENTS 5,687,233 A * 11/1997 Loudermilk et al. ..... 379/442
6,171,152 B1 * 1/2001 Kunz ..... 439/620.18
6,227,911 B1 * 5/2001 Boutros et al. ..... 439/620.18
6,428,361 B1 * 8/2002 Imschweiler et al. ..... 439/676
6,497,588 B1 * 12/2002 Scharf et al. ..... 439/607.38
6,499,890 B2 * 12/2002 Gilliland et al. ..... 385/88
6,554,638 B1 * 4/2003 Hess et al. ..... 439/490
6,811,442 B1 * 11/2004 Lien et al. ..... 439/620.07
6,926,558 B2 * 8/2005 Sasai et al. ..... 439/620.04
6,986,684 B1 * 1/2006 Lien ..... 439/620.07
7,670,183 B2 * 3/2010 Huang et al. ..... 439/620.05
7,786,009 B2 * 8/2010 Machado et al. ..... 438/676
7,959,473 B2 * 6/2011 Machado et al. ..... 439/676

FOREIGN PATENT DOCUMENTS

TW M339836 9/2008

* cited by examiner

*Primary Examiner* — Alexander Gilman
(74) *Attorney, Agent, or Firm* — Wei Te Chung; Ming Chieh Chang

(57) ABSTRACT

An electrical connector (100) includes an insulative housing (11), a terminal module received in the insulative housing and a shielding shell (17) enclosing the insulative housing. The terminal module having an inner circuit board (130) and a number of magnetic coils (132). The inner circuit board defines a groove (1300). Each of magnetic coils includes a core and a number of wires wound on the core and electrically connected with the inner circuit board. Each magnetic coil is at least partially received in the groove to save space for reducing profile of the connector.

20 Claims, 5 Drawing Sheets

MODULAR JACK WITH MAGNETIC MODULE OD REDUCED PROFILE

BACKGROUND OF THE INVENTION

1. Field of the Invention

The present invention relates to a modular jack, and particularly, to a modular jack with a small sized magnetic module to reduce the profile thereof.

2. Description of Related Art

Taiwan Patent No. M339836 issued on Sep. 1, 2008, discloses an electrical connector mounted on a printed circuit board (PCB). The electrical connector includes an insulative housing and a terminal module received therein. The insulative housing defines a receiving room for insertion of a mating connector. The terminal module has an inner circuit board extending horizontally and a number of magnetic coils located below the inner circuit board and electrically connected with the inner circuit board. The magnetic coils are positioned below the inner circuit board and could not utilize space above the inner circuit board, so it makes the height of the connector increased and is not convenient to reduce profile of the connector.

Hence, an improved connector is desired to overcome the above problems.

SUMMARY OF THE INVENTION

A primary object of the present invention is to provide an electrical connector taking reduced space.

To achieve the aforementioned object, an electrical connector includes an insulative housing, a terminal module received in the insulative housing and a shielding shell enclosing the insulative housing. The terminal module having an inner circuit board and a number of magnetic coils. The inner circuit board defines a groove. Each of magnetic coils includes a core and a number of wires wound on the core and electrically connected with the inner circuit board. Each magnetic coil is at least partially received in the groove to save space for reducing profile of the connector.

The foregoing has outlined rather broadly the features and technical advantages of the present invention in order that the detailed description of the invention that follows may be better understood. Additional features and advantages of the invention will be described hereinafter which form the subject of the claims of the invention.

DETAILED DESCRIPTION OF THE INVENTION

Figure 1:
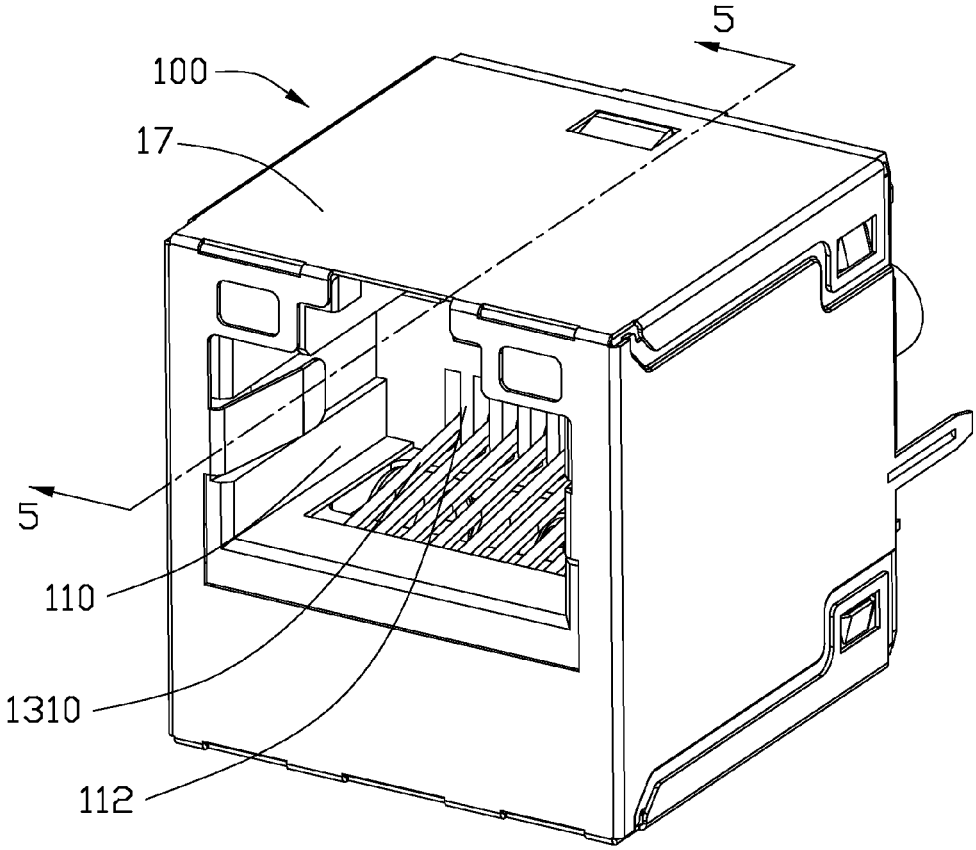
FIG. 1 is an assembled perspective view of an electrical connector in accordance with the embodiment of the present invention.
Figure 2:
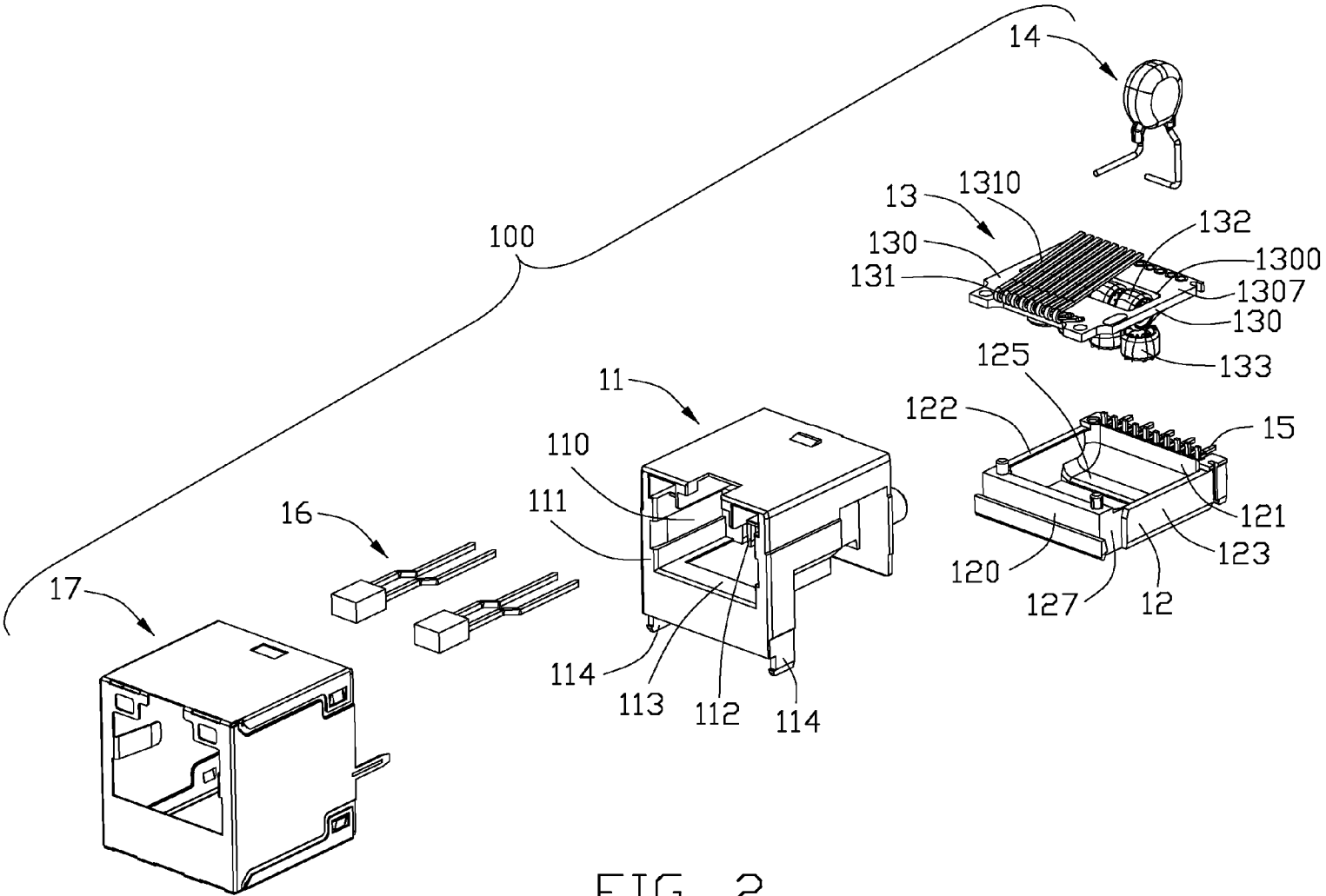
FIG. 2 is an exploded perspective view of the electrical connector as shown in FIG. 1.

Reference will now be made to the drawing figures to describe the present invention in detail. Referring to FIGS. 1-2, an electrical connector 100 in accordance with the embodiment of the present invention is mounted on an outer device (not shown). The connector 100 comprises an insulative housing 11, a terminal module received in the insulative housing 11, a pair of LEDs 16 and a shielding shell 17 enclosing the insulative housing 11. The terminal module comprises a base body 12 assembled to the insulative housing 11, a magnetic module 13 mounted to the base body 12, and a plurality of converting terminals 15 on the base body 12 for electrically connecting to a PCB.

Figure 3:
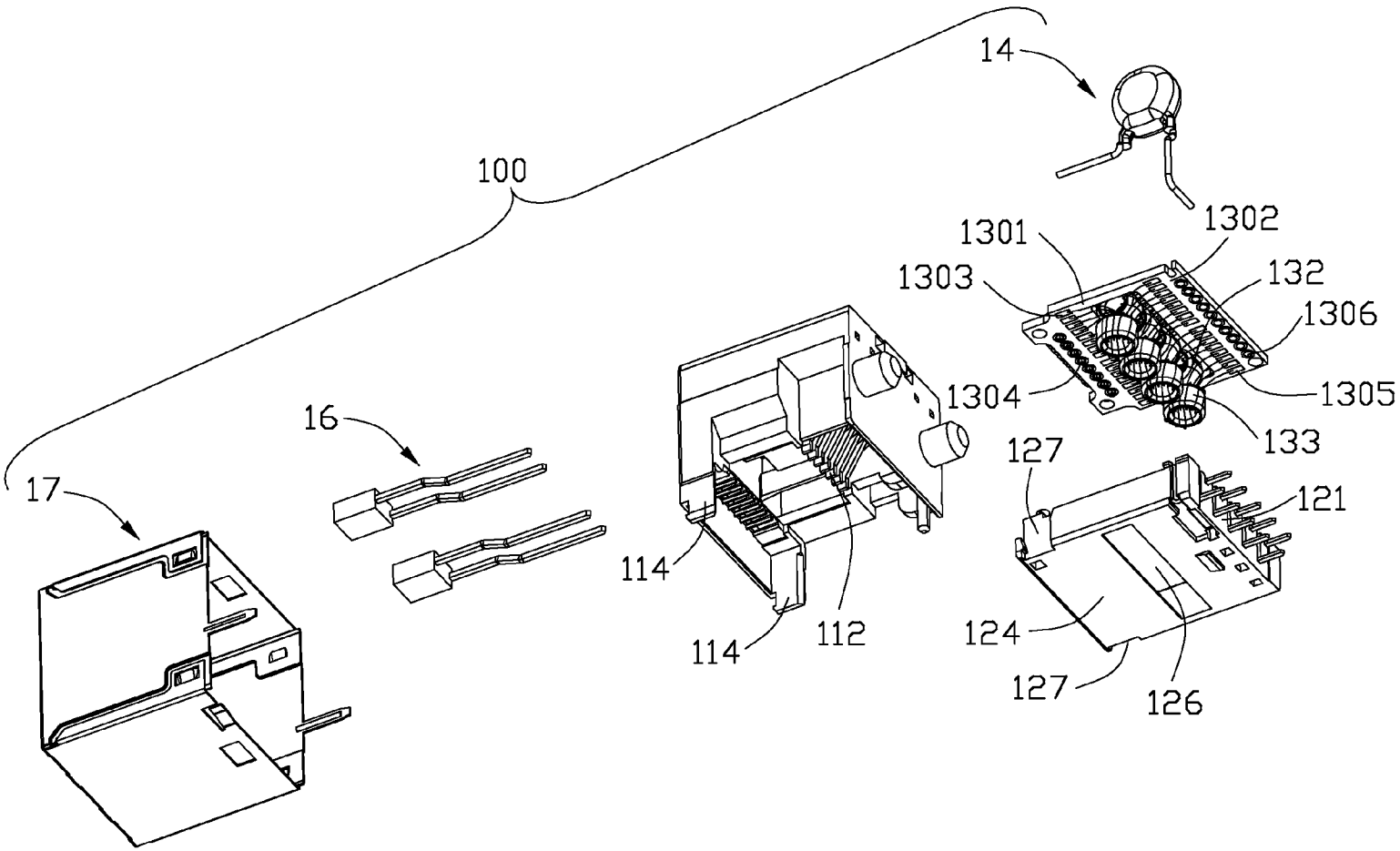
FIG. 3 is another exploded perspective view of the electrical connector as shown in FIG. 1, taken from another aspect.
Figure 4:
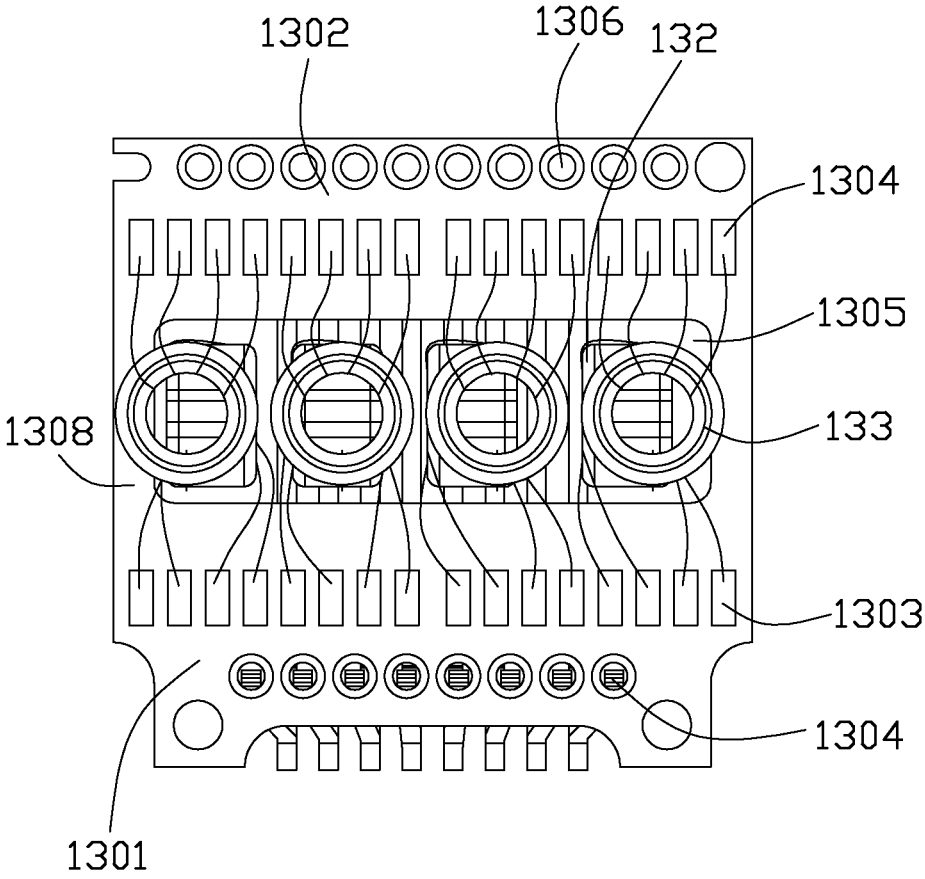
FIG. 4 is an exploded perspective view of the magnetic module as shown in FIG. 3.
Figure 5:
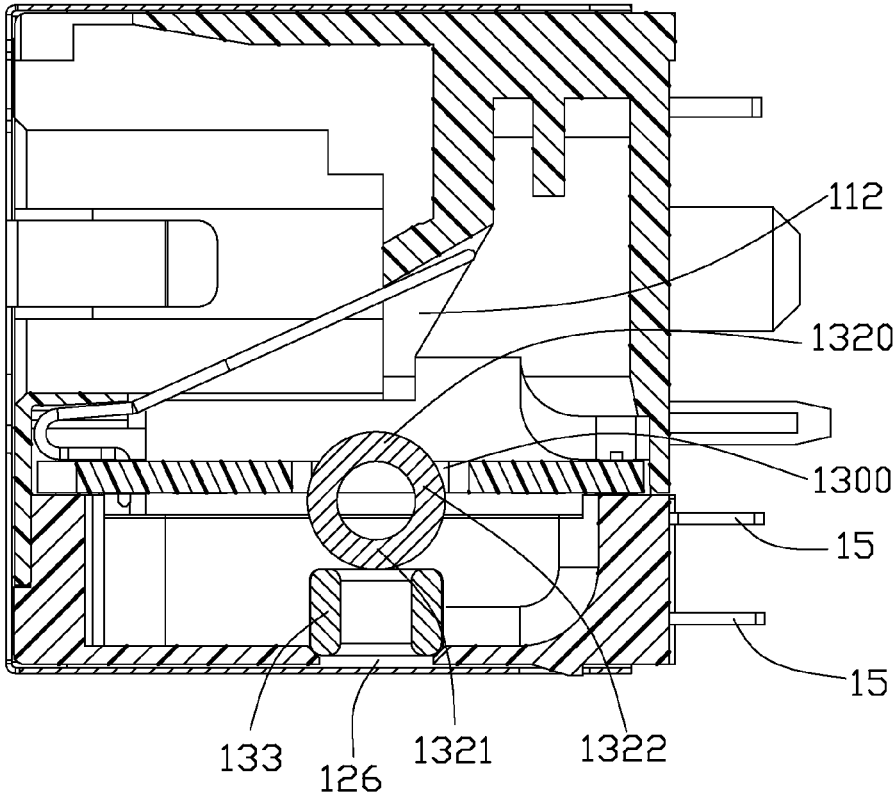
FIG. 5 is a cross-sectional view of the electrical connector taken along line 5-5 of FIG. 1.

Referring to FIGS. 2-3, the insulative housing 11 defines a receiving cavity 110 for insertion of a mating connector (not shown), a front surface 111 defining an opening 113 in communicating with the receiving cavity 110, a pair of retaining devices 114 located respectively at two sides thereof and a plurality of dividing portions 112 opposite to the opening 113.

Referring to FIGS. 2-3, the base body 12 has a front wall 120, a rear wall 121, a left wall 122, a right wall 123 and a lower wall 124, and a chamber 125 defined therebetween. Both the left wall 122 and the right wall 123 have cooperating devices 127 to match with the retaining devices 114. In the embodiment of the present invention, the retaining device 114 extends downwardly towards the base body 12 to form a cantilever with a hook. The cooperating device 127 is configured into an indentation locked with the cantilever. The lower wall 124 defines a slot 126 running through the lower wall 124 and in communicating with the chamber 125. The plurality of converting terminals 15 are retained in the rear wall 121 and extends beyond the rear wall 121 to connect with the outer device.

Referring to FIGS. 2-5, the magnetic module 13 comprises an inner circuit board 130 above the base body 12, a plurality of mating terminals 131 soldered on a front portion of the inner circuit board 130 to connect with the mating connector, and a number of magnetic coils 132 and accessorial coils 133 associated with the inner circuit board 130.

The inner circuit board 130 extends horizontally and has a first surface 1307 and an opposite second surface 1308. The inner circuit board 130 defines a groove 1300 aligned with the slot 126 and running through both the first surface 1307 and the second surface 1308. The magnetic coils 132 are at least partially received in the groove 1300. Each of magnetic coils 132 has a magnetic core and a plurality of wires wound around the magnetic core and electrically connected with the inner circuit board 130. The magnetic coils 132 are adhered in the groove 1300 by glue and each of the magnetic coils 132 includes a first part 1320, a second part 1321 and a third part 1322. The first part 1320 is located above the first surface 1307, the second part 1321 is located below the second surface 1308 and the third part 1322 is received in the groove 1300 entirely. Optionally, in other embodiment of the present invention only one of the first part 1320 and the second part 1321 is located at one side of the inner circuit board 130.

The magnetic coils 132 not only occupy the room of the groove 1300 but also utilize the space of two sides of the inner circuit board 130 to reduce profile of the connector 100. Each of the accessorial coils 133 has a magnetic core and some wires wound on the magnetic core and electrically connected with the inner circuit board 130. Each accessorial coil 133 is arranged beside the groove 1300 and is coupled with one magnetic coil 132 by glue. The inner circuit board 130 comprises a first area 1301 at a front portion thereof and a second area 1302 opposite to the first area 1301 with the groove 1300 located therebetween. The first area 1301 defines a row of first pads 1303 and a row of first soldering holes 1304 parallel to the first pads 1303. The mating terminals 131 are soldered to the first soldering holes 1304. The second area 1302 defines a row of second pads 1305 and a row of second soldering holes 1306 parallel to the second pads 1305. The converting terminals 15 are soldered to the second soldering holes 1306. The magnetic coils 132 electrically connect with the first pads 1303 with wires soldered thereon and the accessorial coils 133 electrically connect with the second pads 1305 with wires soldered thereon. Besides, the terminal module comprises a capacitor 14 having a pair of feet. One foot is soldered on the inner circuit board 130 and the other foot abuts against the outer surface of the lower wall 124. When the shielding shell 17 encloses the insulative housing 11, the foot attached to the lower wall 124 will contact the shielding shell 17 to realize grounding.

Each of the mating terminals 131 has a contacting portion 1310 projecting into the receiving cavity 110 and connecting with the mating connector. The dividing portion 112 extends towards the inner circuit board 130 along a direction perpendicular to the inner circuit board 130. Adjacent contacting portions 1310 are spaced by the dividing portion 112. The inner circuit board 130 is located between the contacting portion 1310 and the lower wall 124 of the base body 12. The second part 1321 of the magnetic coils 132 and the accessorial coils 133 are received in the chamber 125. The slot 126 of the lower wall 124 provides an extra room for the accessorial coils 133 entering partially. Therefore, The accessorial coils 133 could be accommodated in the chamber 125 conveniently.

However, the disclosure is illustrative only, changes may be made in detail, especially in matter of shape, size, and arrangement of parts within the principles of the invention.

What is claimed is:

1. An electrical connector comprising:

an insulative housing defining a receiving cavity therein for insertion of a mating connector;

a terminal module received in the insulative housing, the terminal module having an inner circuit board, a base body assembled with the housing and a plurality of magnetic coils, the inner circuit board defining a groove, the base body defining a chamber and a slot in alignment with the groove, each of the magnetic coils comprising a core and a number of wires wound around the core and electrically connected with the inner circuit board; wherein said magnetic coils includes a first coil being at least partially received in the groove, and a second coil being at least partially received in the slot.

2. The electrical connector as claimed in claim 1, wherein said inner circuit board has a first surface and a second surface opposite to the first surface, the groove running through both the first surface and the second surface, the core of first coil stacked upon the core of second coil, the wires wounding around the core of first coil and then around the core of second coil.

3. The electrical connector as claimed in claim 2, wherein said first coil includes a first part located above the first surface, a second part located below the second surface and a third part received in the groove entirely.

4. The electrical connector as claimed in claim 3, wherein said second part of the first coil received in the chamber.

5. The electrical connector as claimed in claim 1, wherein said first coil includes an outer part located at one side of the inner circuit board and an inner part received in the groove entirely.

6. The electrical connector as claimed in claim 1, wherein said first coil is adhered in the groove by glue.

7. The electrical connector as claimed in claim 1, wherein said second coil couples with the first coil by glue and is located below the first coil.

8. The electrical connector as claimed in claim 7, wherein the inner circuit board extends horizontally and defines a plurality of first pads at a front portion thereof with the first coil soldered on the first pads, and a plurality of second pads at a rear portion thereof with the second coil soldered on the second pads.

9. The electrical connector as claimed in claim 7, wherein said second coil is at least partially received in the chamber.

10. An electrical connector comprising:

an insulative housing defining a mating port;

a plurality of terminals defining mating sections exposed into the mating port;

a printed circuit board defining a groove through opposite first and second surfaces in a vertical direction; and a set of magnetic coils side by side arranged with one another along a lengthwise direction perpendicular to said vertical direction, each of said magnetic coils including a core with at least two wound wires each having corresponding ends, and each of said magnetic coils at least partially disposed in said groove; wherein an axis of said core of each of said magnetic coils extends in said lengthwise direction.

11. The electrical connector as claimed in claim 10, wherein the terminals are deflectable above the first surface, and the magnetic coils are essentially exposed upon the second surface more than the first surface.

12. The electrical connector as claimed in claim 10, further including a base portion located upon a second surface to receive a portion of each of the magnetic coils.

13. The electrical connector as claimed in claim 12, further including another set of magnetic coils each connected to the corresponding magnetic coil of the set of magnetic coils in the groove and received in the base portion.

14. The electrical connector as claimed in claim 13, wherein each of said another set of magnetic coils includes a core with at least two wound wires each having corresponding ends, and the axis of the core of each of said another set of magnetic coils extends perpendicular to the printed circuit board and in said vertical direction.

15. The electrical connector as claim 14, where two rows of solder pads respectively located by two sides of said groove in a transverse direction perpendicular to said vertical direction and said lengthwise direction, and said ends of said two wires of said set of magnetic coils are commonly mechanically and electrically connected to the corresponding solder pads in one of said two rows while said ends of said two wires of said set of magnetic coils are commonly mechanically and electrically connected to the corresponding solder pads in the other of said two rows.

16. The electrical connector as claimed in claim 10, wherein two rows of solder pads respectively located by two sides of said groove in a transverse direction perpendicular to said vertical direction and said lengthwise direction, and said ends of said two wires of said set of magnetic coils are commonly mechanically and electrically connected to the corresponding solder pads in one of said two rows.

17. The electrical connector as claimd in claim 10, wherein said groove extends along the lengthwise directin withut interruption.

18. An electrical connector comprising:

a housing defining a mating port;

a plurality of terminals having deflectable mating sections exposed in the mating port;

a printed circuit board defining a groove extending through opposite first and second surfaces thereof in a vertical direction;

a first set of magnetic coils side by side arranged with one another in a lengthwise direction perpendicular to said vertical direction, each of said first set of magnetic coils defining one core and at least two wounded wires each having corresponding ends, an axis of the core of each of the first set of magnetic coils extending in said lengthwise direction parallel to said first surface and said second surface;

a second set of magnetic coils side by side arranged with one another, the second set of magnetic coils intimately located beside the first set of magnetic coils in said vertical direction in a one-to-one relation correspondingly, and each of said second set of magnetic coils defining one core and at least two wound wires each having corresponding ends, the axis of the core of each of the second set of magnetic coils extending perpendicular to the first surface and the second surface and along said vertical direction; wherein the first set of magnetic coils is at least partially received in the groove.

19. The electrical connector as claimed in claim 18, wherein the mating sections are deflectable above the first surface, and the second set is fully exposed upon the second surface.

20. The electrical connector as claimed in claim 19, wherein said first set is exposed upon the second surface more than the first surface.

* * * * *